US010876382B2

(12) United States Patent
Carleton

(10) Patent No.: US 10,876,382 B2
(45) **Date of Patent: *Dec. 29, 2020**

(54) APPARATUSES AND METHODS FOR GAS EXTRACTION FROM RESERVOIRS

(71) Applicant: Kurt Carleton, Lafayette, LA (US)

(72) Inventor: Kurt Carleton, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/941,634

(22) Filed: Mar. 30, 2018

(65) Prior Publication Data

US 2018/0223637 A1 Aug. 9, 2018

Related U.S. Application Data

(63) Continuation of application No. 13/791,138, filed on Mar. 8, 2013, now Pat. No. 9,951,592.

(51) Int. Cl.
*E21B 43/12* (2006.01)

(52) U.S. Cl.
CPC ..... *E21B 43/122* (2013.01); *E21B 43/12* (2013.01)

(58) Field of Classification Search
CPC ..... E21B 43/12; E21B 43/18; E21B 47/00
See application file for complete search history.

(56) References Cited

U.S. PATENT DOCUMENTS

| | | | | |
|---|---|---|---|---|
| 4,345,647 | A * | 8/1982 | Carmichael | E21B 33/122 166/189 |
| 4,359,092 | A | 11/1982 | Jones | |
| 5,407,010 | A | 4/1995 | Herschberger | |
| 9,951,592 | B2 * | 4/2018 | Carleton | E21B 43/12 |
| 2002/0049575 | A1 | 4/2002 | Jalali et al. | |
| 2004/0244991 | A1 | 12/2004 | Reitz | |
| 2008/0185151 | A1 | 8/2008 | Uttley | |
| 2009/0008101 | A1 | 1/2009 | Coady | |
| 2011/0278015 | A1 | 11/2011 | Mazzanti | |
| 2015/0013993 | A1 * | 1/2015 | Armistead | E21B 17/18 166/381 |

* cited by examiner

*Primary Examiner* — Kenneth L Thompson
(74) *Attorney, Agent, or Firm* — Jason P. Mueller; FisherBroyles, LLP

(57) ABSTRACT

Apparatuses and methods for extracting gas from a reservoir including a well bore having a large cross sectional area which may be determined by dividing a target flow rate of the reservoir by an actual sustained flow rate and multiplying a result by a flow path area for the actual sustained flow rate. A method of converting a well of a low pressure gas reservoir is further provided.

18 Claims, 2 Drawing Sheets

APPARATUSES AND METHODS FOR GAS EXTRACTION FROM RESERVOIRS

CROSS-REFERENCE TO RELATED APPLICATIONS

This application is a continuation of U.S. patent application Ser. No. 13/791,138, filed Mar. 8, 2013, the entire contents of which are incorporated herein by reference in its entirety.

FIELD

The present invention relates to apparatuses and methods for extracting gas from reservoirs, and in particular though non-limiting embodiments, apparatuses and methods of utilizing large well bore flows to increase gas extraction from large gas reservoirs.

BACKGROUND

Hydrocarbon reservoirs form from the transformation of organic matter into hydrocarbon materials, including coals, tars, oils, waxes and natural gas. The reservoirs form as lighter hydrocarbon molecules percolate toward the surface until they are trapped beneath a relatively impermeable layer. The lighter hydrocarbon molecules continue to accumulate below the impermeable layer into sub-surface reservoirs. The reservoirs, being at various depths within the earth, may be under substantial geostatic pressure.

Generally, gas is extracted from reservoirs by drilling a borehole into a sub-surface formation containing gas. Initially, reservoirs are characterized by having high pressure levels. This naturally occurring pressure allows for a primary recovery period wherein the gas is driven upwardly through a well bore by pressure within the reservoir. The initial pressures in a gas reservoir are usually substantially higher than a gas sales line pressure (the surface flow line for delivery of the gas), often requiring a choke to control or hold back pressure in order to produce a well at a flow rate generally determined by reservoir, market and equipment parameters.

As gas is extracted from a gas reservoir, the reservoir's pressure ultimately declines below the gas sales line pressure, which subsequently reduces flow rates in the well bore. Additionally, due to the pressure decline in the reservoir, the gas in the reservoir increases its affinity to hold higher concentrations water vapor, increasing water to gas ratios for the extracted product. Ultimately, the natural pressure becomes so depleted that recovery of natural gas from the reservoir is no longer possible under natural pressure forces.

When the natural pressure of the reservoir declines to a point that the natural pressure no longer supports extraction or economical extraction of the gas, secondary recovery operations may be employed to extract additional gas from the reservoir. Compression of the surface flow line is generally the first method of maintaining economic production after a well bore flow pressure declines to below gas sales line pressure. Compression may be a single stage or multiple stages in order to further lower pressure at the well head.

In addition to compression, other commonly applied enhancement methods may aid in continuing reservoir depletion. These methods are performed to reduce or stay ahead of liquid loading, which is the predominate cause for abandonment of gas wells. Liquid loading occurs when a velocity of gas travelling vertically from a formation to the surface is lower than a velocity required to carry a fluid produced by the reservoir. In the case of dry gas reservoirs, liquid loading may result primarily from water vapor condensing as it travels upwards vertically towards the surface. Formation of hydrocarbon condensate in the well may also contribute to liquid loading of dry gas reservoirs.

Various additional secondary recovery operations have been employed to maintain gas extraction as reservoir pressure declines, ultimately to abandonment pressure, including, but not limited to, plunger lift, continuous or intermittent gas lift, soap injection or sticks, intermittent shut-in and production, alternating production from two or more different flow paths and down hole mechanical or jet pumps. Notwithstanding these secondary recovery operations, a reservoir typically cannot be economically depleted lower than a certain pressure, which is usually approximately 200 PSI.

As natural pressure declines during extraction, gas travelling from the reservoir to the surface through production tubing encounters increasingly higher friction pressures due to lowered flow pressures, increasing water to gas ratios and decreasing reservoir pressure. As a result, economic extraction and/or consistent flow rates through the production tubing becomes impracticable at lower pressures even though the reservoir may still contain large amounts of gas. A well is said to reach an economic limit when its most efficient production rate no longer covers the operating expenses for extraction and delivery of the extracted product. Typically, for gas wells, decreased flow pressures and increased water to gas ratios may cause a well to reach its economic limit when the pressure of the reservoir reaches 200 PSI or less. Under current technologies, extraction from such wells can no longer cover the costs of extraction/production of gas. Ultimately, such wells are abandoned due to the economics of exploitation notwithstanding the fact that the reservoirs potentially contain substantial additional gas available for extraction.

Accordingly, there is need for new apparatuses and methods of gas extraction to increase production rates and amounts of gas recovered from low pressure gas reservoirs.

SUMMARY

Figure 1:
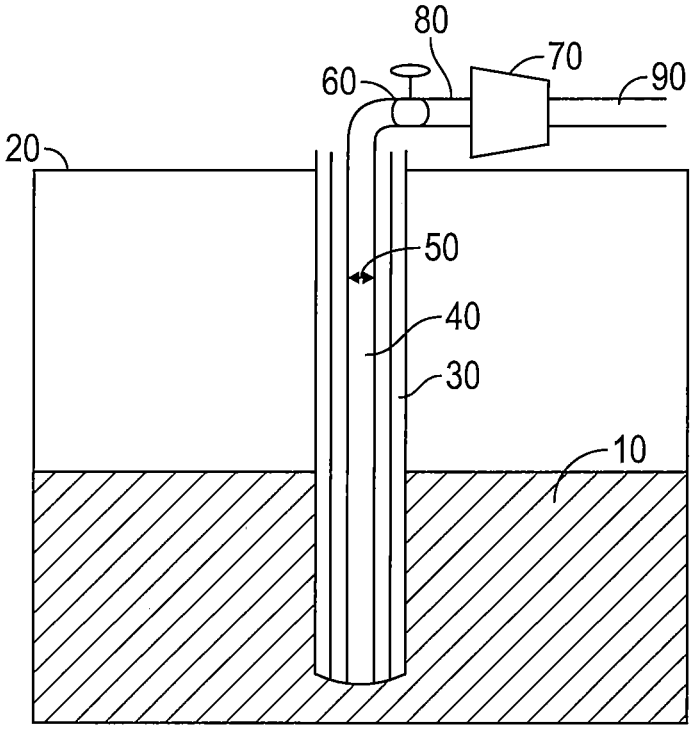
FIG. 1 is a drawing of a typical gas well.

In an example embodiment of the present invention, an apparatus for extracting gas from a reservoir is provided, including: a hollow well bore, having a distal end in contact with the gas reservoir, a proximal end above the earth's surface, a length and a cross sectional area; a surface flow line, connected to the proximal end of the well bore and extending distally away from the well bore; and at least one stage of compression connected to the surface flow line and configured to compress contents of the surface flow line as the contents pass distally away from the well bore. The reservoir has an internal pressure of less than 200 PSI. A size of the cross sectional area of the well bore is approximately equivalent to a value determined by dividing a target flow rate of the reservoir by an actual sustained flow rate and multiplying a result by a flow path area for the actual sustained flow rate. A cross sectional area of the surface flow line is larger than the cross section area of the well bore. The at least one stage of compression is sized such that an inlet pressure is approximately 0 PSI to approximately 10 PSI lower than flowing pressure of the well bore at the proximal end.

The cross sectional area of the well bore may be substantially the same throughout the length of the well bore. The well bore may be substantially circular. The cross sectional area of the well bore may be at least 20 square inches. The cross sectional area of the well bore may be at least 30 square inches. The well bore may be comprised of production casing of an existing well. The cross sectional area of the well bore may be substantially equivalent to a cross sectional area of the production casing. The cross sectional area of the well bore may be substantially equivalent to a tubing/casing annulus. The reservoir may have a flow capacity above 1,500 millidarcy-feet. A salinity measurement of water produced from the reservoir may be less than 1000 PPM chlorides. A density measurement of water produced from the reservoir may be approximately 8.33 pounds per gallon. The apparatus may further include a vacuum applied to the proximal end of the well bore configured to reduce pressure within the well bore at the proximal end of the well bore. The reservoir may be a dry gas reservoir.

According to an example embodiment of the present invention, an apparatus for extracting gas from a reservoir is provided, including: a hollow well bore, having a distal end in contact with the gas reservoir, a proximal end above the earth's surface, a length and a cross sectional area; and a surface flow line, connected to the proximal end of the well bore and extending distally away from the well bore. The reservoir has an internal pressure of less than 200 PSI. A size of the cross sectional area of the well bore is approximately equivalent to a value determined by dividing a target flow rate of the reservoir by an actual sustained flow rate and multiplying a result by a flow path area for the actual sustained flow rate.

The cross sectional area of the well bore may be substantially the same throughout the length of the well bore. A cross sectional area of the surface flow line may be larger than the cross section area of the well bore. The apparatus may further include at least one stage of compression connected to the surface flow line and configured to compress contents of the surface flow line as the contents pass distally away from the well bore. The at least one stage of compression may be configured such that an inlet pressure is approximately 0 PSI to approximately 10 PSI lower than flowing pressure of the well bore at the proximal end. The well bore may be substantially circular. The cross sectional area of the well bore may be at least 20 square inches. The cross sectional area of the well bore may be at least 30 square inches. The well bore may be comprised of production casing of an existing well. The cross sectional area of the well bore may be substantially equivalent to a cross sectional area of the production casing. The cross sectional area of the well bore may be equivalent to a tubing/casing annulus.

According to an example embodiment of the present invention, a method of extracting gas from a reservoir is provided, including: employing a hollow well bore, having a distal end, a proximal end, a length and a cross sectional area, into the reservoir such that the distal end is in contact with the reservoir and the proximal end extends beyond the earth's surface; connecting a surface flow line to the proximal end of the well bore; and compressing the gas within the surface flow line as the gas passes distally away from the well bore. The reservoir has an internal pressure of less than 200 PSI. A size of the cross sectional area of the well bore is approximately equivalent to a value determined by dividing a target flow rate of the reservoir by an actual sustained flow rate and multiplying a result by a flow path area for the actual sustained flow rate. A cross sectional area of the surface flow line is larger than the cross section area of the well bore. Compression of the gas within the surface flow line is configured such that an inlet pressure is approximately 0 PSI to approximately 10 PSI lower than the pressure of the well bore.

The cross sectional area of the well bore may be substantially the same throughout the length of the well bore. The well bore may be substantially circular. The cross sectional area of the well bore may be at least 20 square inches. The cross sectional area of the well bore may be at least 30 square inches. The well bore may be comprised of production casing of an existing well. The cross sectional area of the well bore may be substantially equivalent to a cross sectional area of the production casing. The cross sectional area of the well bore may be equivalent to a tubing/casing annulus.

According to an example embodiment of the present invention, a method of converting an existing well of a gas reservoir having a pressure of 200 PSI or less is provided, including: connecting a proximal end of production casing of the existing well to a surface flow line; and compressing the gas within the surface flow line as the gas passes distally away from the production casing. The production casing serves as a well bore having a distal end, a proximal end, a length and a cross sectional area. The distal end is in contact with the reservoir and the proximal end extends beyond the earth's surface. A cross sectional area of the surface flow line is larger than a cross section area of the production casing. Compression of the gas within the surface flow line is configured such that an inlet pressure is approximately 0 PSI to approximately 10 PSI lower than the pressure of the well bore.

Production tubing from the existing well may be removed. Production tubing from the existing well may be left in place.

According to an example embodiment of the present invention, a method of screening a reservoir as a candidate for the apparatus described in claim 1 is provided, including: measuring pressure within the reservoir; determining flow capacity of the reservoir; measuring at least one of salinity and density of water produced by the reservoir; and determining the size of the reservoir. The pressure measurement is below 200 PSI. The flow capacity is above 1,500 millidarcy-feet. The salinity of the water is less than 1000 PPM and the density of the water is approximately 8.33 pounds/gallon or less. The size of the reservoir is such that an economic value of one-half of the gas in the reservoir exceeds an economic cost to employ the apparatus of claim 1.

DESCRIPTION

Like reference characters denote like parts in the drawings.

According to example embodiments of the present invention, a gas extracting apparatus, including a large well bore, is provided, which enhances gas extraction/recovery from a reservoir. Embodiments of the present invention may be utilized to increase flow rates and/or amounts of gas recovered from a reservoir. Embodiments of the present invention may be employed to recover gas from large reservoirs that have low pressures due to prior extractions. Embodiments may increase gas recovery amounts from reservoirs. Embodiments may increase flow rates of recovered gas. According to certain embodiments, the present disclosure may increase the economic productivity of gas reservoirs and/or allow for economical exploitation of reservoirs that cannot be economically exploited under current technologies/methods. Embodiments may be useful for gas extraction from large gas reservoirs that may have high flow capacity and/or high permeability.

Typically, a gas well for gas extraction from a reservoir will incorporate production tubing that extends from the surface down to the reservoir, which production tubing may pass inside a casing or other components of the well placed inside a hole. FIG. 1 is a representative of a typical gas well, including production tubing 40, which passes into reservoir 10 and extends above the earth's surface 20. Production tubing 40 passes within casings 30, which form the outer circumference of the well. The production tubing has an internal diameter 50, which is typically approximately 2 to approximately 3 inches. The production tubing 40 extends to a well head 60 and connects to surface flow line 80. The well head 60 may include a choke or other mechanism for controlling flow from production tubing 40 as gas passes into surface line 80. After initial pressures are reduced below the pressure desired for the production tubing as it proceeds for ultimately disbursement or sale 90, compressor 70 may be incorporated to compress the gas within surface flow line 80 and reduce the pressure within production tubing 40.

Figure 2:
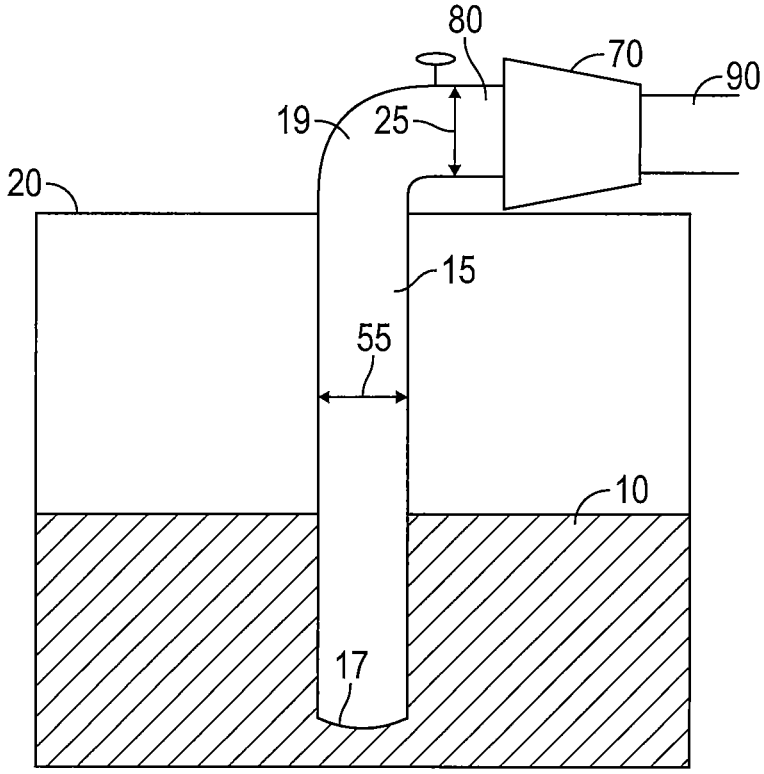
FIG. 2 is a drawing a large well bore, according to an embodiment of the present invention.

FIG. 2 provides a drawing of an embodiment of the present invention. As shown, the present invention includes well bore 15 extending into a reservoir 10 containing gas. Well bore 15 has a length, an internal diameter 55, a distal end 17, which is in contact with reservoir 10, and a proximal end 19, which extends beyond the earth's surface 20. Well bore 15 is connected to a surface flow line 80, which may be substantially parallel to the earth's surface. In certain embodiments, well bore 15 and surface flow line 80 may be connected via larger wellhead valves and flow tees than previous equipment used for production through production tubing 40. The larger wellhead valves and flow tees may be substantially equivalent to a size of surface flow line 80 having an internal diameter 25. Internal diameter 25 may be larger than internal diameter 55. A length of surface flow line 80 may be minimized as conditions may allow which may decrease pressure drops. Embodiments of the present disclosure may incorporate compressor 70 and may include one or more stages of compression to increase pressures of surface flow line 80 as the gas travels away from well bore 15 and to decrease pressure at proximal end 19 of well bore 15. Embodiments may incorporate a vacuum at or near the proximal end of well bore 15 to reduce pressures at proximal end 19. Well bore 15 and surface flow line 80 may be steel or any other material suitable for gas extraction.

Figure 3:
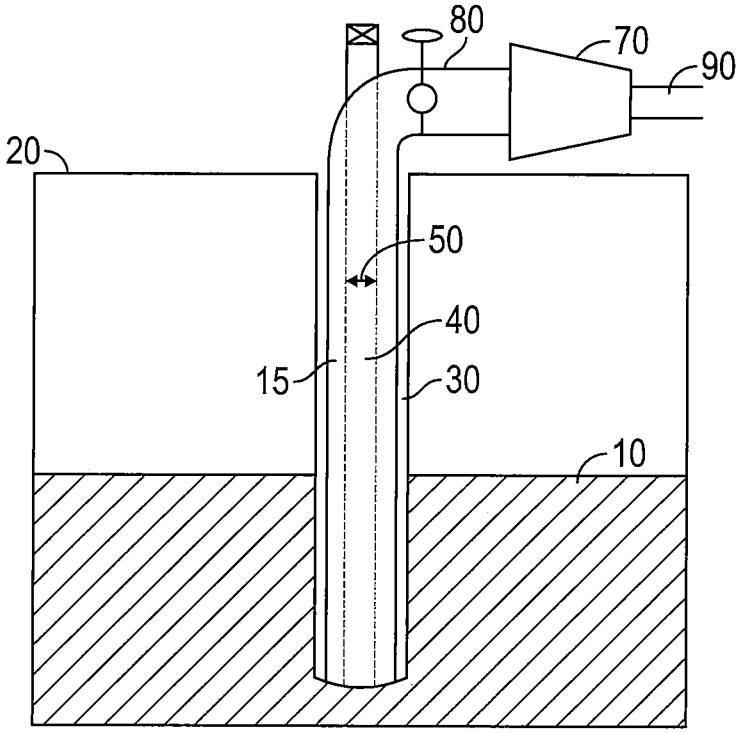
FIG. 3 is a drawing of a large well bore, according to an embodiment of the present invention.

In various embodiments, well bore 15 may comprise casings 40 from an existing gas well, which gas well may no longer be in production. The exemplary embodiment shown in FIG. 3 shows well bore 15 formed from casings 40 wherein production tubing 40 remains in place. In such embodiment, well bore 15 consists of the annular space between an interior surface of casings 30 and an exterior surface of production tubing 40. The annular space may be referred as a tubing/casing annulus. As shown in FIG. 3, embodiments of the present disclosure may include a surface flow line 80 having a larger cross sectional area than a cross sectional area of the annular space between the interior surface of casings 30 and the exterior surface of production tubing 40. In alternative embodiments, well bore 15 may be constructed by removing tubing, packers and down hole equipment of an existing gas well. In such embodiments, well bore 15 may be formed from casings 30. In other embodiments, well bore 15 may be inserted at a new drill site of a reservoir that has previously been exploited for gas extraction.

Figure 4:
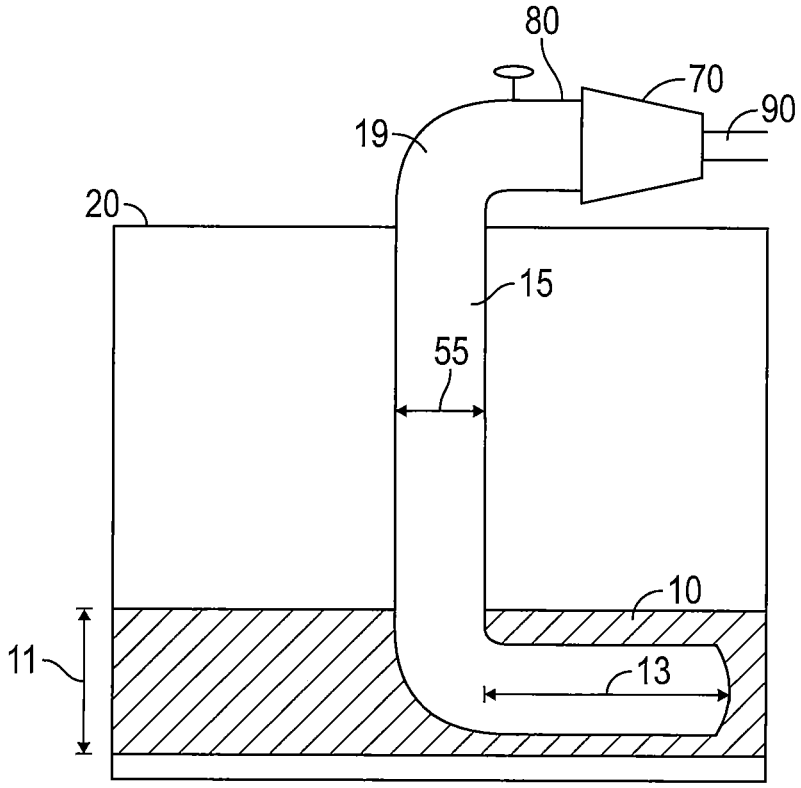
FIG. 4 is a drawing of a large well bore, according to an embodiment of the present invention.

In the exemplary embodiment shown in FIG. 4, well bore 15 intersects or contacts reservoir 10 horizontally. In this exemplary embodiment, reservoir 10 has a thickness 11 and a horizontal section of well bore 15 has a length 13. This alternative embodiment may be employed to increase flow capacity of well bore 15. Flow capacity for a vertical well bore may be calculated as reservoir thickness 11 multiplied by permeability of reservoir 10. In horizontal embodiments, flow capacity may be calculated as length 13 multiplied by permeability of reservoir 10. Accordingly, flow capacity of well bore 15 may be increased in horizontal embodiments of the present invention where length 13 is greater than reservoir thickness 11.

Well bore 15 has a cross sectional area configured to be approximately equivalent to a value determined by dividing a target flow rate of the reservoir by an actual sustained flow rate and multiplying a result by a flow path area for the actual sustained flow rate. For example, if a well flowing through 2-⅞" production tubing that is inside 7" casing recently produced 400 thousand cubic feet per day and the target rate, based on bottom hole flowing pressure and a reservoir inflow performance curve, is 2500 thousand cubic feet per day, then a value determined by dividing a target flow rate of the reservoir by an actual sustained flow rate and multiplying the result by a flow path area for the actual sustained flow rate would be $2500/400\times(3.1416)(2.441)(2.441)/4=29.25$ square inches. The resulting value is approximate to the cross sectional area of the 7" casing. In this example, the casing could be converted by removing production tubing, leaving a large well bore that will provide increased flow rates and additional gas recovery. In certain embodiments, well bore 15 may have a cross sectional area of approximately 20 square inches or larger. In certain embodiments, the cross sectional area of the well bore may be at least 30 square inches.

In the embodiment shown in FIG. 2, well bore 15 is substantially circular and the cross sectional area is configured based upon internal diameter 55. The embodiment shown in FIG. 2 may be employed to extract gas from reservoirs previously depleted such that gas extraction is marginal or economically unfeasible under other known methods. Embodiments of the present disclosure may permit economical gas extraction from reservoirs having pressures of 200 PSI or less.

In various embodiments, the surface flow line 80 is configured to have a cross sectional area larger than the cross sectional area of well bore 15, which may reduce back pressure in the well bore. In embodiments incorporating one or more stages of compression to compress gas in the surface flow line, compression may be sized such that the compression produces an inlet pressure of approximately 0 PSI to approximately 10 PSI lower than the pressure from the well bore for an anticipated flow rate. This additional capacity will insure steady flow and generally allow the one or more stages of compression to properly perform as reservoir pressures decline.

In certain embodiments of the present invention, a method is provided for screening reservoirs as candidates for large well bore extraction. Reservoirs may be identified as candidates generally if reservoir pressure is insufficient to permit economic gas extraction under existing methods. Typically, this will include reservoirs having a pressure of 200 PSI or less. In certain embodiments, flow capacity of a candidate reservoir should be relatively high; typically above 1,500 millidarcy-feet. If flow capacity information of a reservoir is not available, early life low differential between flowing and shut wellhead pressures indicates high flow capacity.

In exemplary embodiments, single phase reservoir production composition may be determined, with reservoirs having production primarily as gas phase only being more suitable as candidates for large well bore extraction. Single phase reservoir production composition may be confirmed by measuring salinity or density of produced water from the reservoir. Fresh production water (less than 1,000 PPM chlorides) and a density of approximately 8.33 pounds per gallon are both indicators that the production composition from reservoir 10 is primarily gas with no liquid water.

In various embodiments, the reservoir size may be large since any gas remaining in place at a reservoir pressure of less than 200 PSI typically represents less than ten percent of the original gas of the reservoir. The present disclosure allows recovery of approximately one half or more of the remaining gas in place. Accordingly, the reservoir size should be sufficiently large such that a value of the anticipated recovered gas exceeds the economic costs to convert an existing well to a large well bore or drill a new well to accommodate a large well bore.

The apparatuses and methods described herein may be utilized in conjunction with known secondary recovery methods/procedures such as those identified in the background. Secondary recovery methods/procedures may be utilized to increase production of large well bores of the present invention.

While the embodiments of the present invention are described with reference to various implementations and exploitations, it will be understood that these embodiments are illustrative and that the scope of the inventions is not limited to them. Many variations, modifications, additions, and improvements are possible. Further still, any steps described herein may be carried out in any desired order, and any desired steps may be added or deleted.

What is claimed:

1. An apparatus for extracting gas from a reservoir having a pressure of 200 PSI or less, comprising:

a well bore, having a distal end in contact with the gas reservoir, a proximal end above the earth's surface, a well bore length, and a well bore cross sectional area;

a surface flow line, connected to the proximal end of the well bore and extending distally away from the well bore; and at least one stage of compression connected to the surface flow line and configured to compress contents of the surface flow line as the contents pass distally away from the well bore;

wherein the surface flow line has a surface flow cross sectional area larger than the well bore cross sectional area;

wherein the at least one stage of compression is sized such that an inlet pressure is approximately 0 PSI to approximately 10 PSI lower than a flowing pressure of the well bore at the proximal end, and wherein the apparatus is configured to extract gas from the reservoir based on a naturally occurring pressure less than 200 PSI.

2. The apparatus of claim 1, wherein a size of the cross sectional area of the well bore is approximately equivalent to a value determined by dividing a target flow rate of the reservoir by an actual sustained flow rate and multiplying a result by a flow path area for the actual sustained flow rate.

3. The apparatus of claim 1, wherein the well bore cross sectional area is substantially the same throughout the length of the well bore.

4. The apparatus of claim 1, wherein the well bore is substantially circular.

5. The apparatus of claim 1, wherein the well bore cross sectional area is at least 20 square inches.

6. The apparatus of claim 1, wherein the well bore cross sectional area is at least 30 square inches.

7. The apparatus of claim 1, wherein the well bore is comprised of a production casing of an existing well.

8. The apparatus of claim 7, wherein the well bore cross sectional area is substantially equivalent to a cross sectional area of the production casing.

9. The apparatus of claim 7, wherein the well bore cross sectional area bore is substantially equivalent to a tubing/casing annulus.

10. The apparatus of claim 1, wherein the reservoir has a flow capacity above 1,500 millidarcy-feet.

11. The apparatus of claim 1, wherein a salinity measurement of water produced from the reservoir is less than 1000 PPM chlorides.

12. The apparatus of claim 1, wherein a density measurement of water produced from the reservoir is approximately 8.33 pounds per gallon.

13. The apparatus of claim 1, further comprising: a vacuum applied to the proximal end of the well bore configured to reduce pressure within the well bore at the proximal end of the well bore.

14. The apparatus of claim 1, wherein the reservoir is a dry gas reservoir.

15. A method of converting an existing well of a gas reservoir having a pressure of 200 PSI or less, comprising:

connecting a proximal end of a production casing of the existing well to a surface flow line; and compressing gas within the surface flow line as the gas passes distally away from the production casing;

wherein the production casing serves as a well bore having a well bore distal end, a well bore proximal end, a well bore length and a well bore cross sectional area; wherein the well bore distal end is in contact with the reservoir and the well bore proximal end extends beyond the earth's surface; and wherein compression of the gas within the surface flow line is configured such that an inlet pressure is approximately 0 PSI to approximately 10 PSI lower than a pressure within the well bore.

16. The method of claim 15, wherein a production tubing from the existing well is removed.

17. The method of claim 15, wherein a production tubing from the existing well is left in place.

18. A method of screening a reservoir as a candidate for the apparatus described in claim 1, comprising:

measuring pressure within the reservoir; determining flow capacity of the reservoir;

measuring at least one of salinity and density of water produced by the reservoir; and determining the size of the reservoir;

wherein the pressure measurement is below 200 PSI;

wherein the flow capacity is above 1,500 millidarcy-feet;

wherein the salinity of the water is less than 1000 PPM and the density of the water is approximately 8.33 pounds/gallon or less; and wherein the size of the reservoir is such that an economic value of one-half of the gas in the reservoir exceeds an economic cost to employ the apparatus of claim 1.

* * * * *